US008777676B1

(12) United States Patent
Mortun et al.

(10) Patent No.: US 8,777,676 B1
(45) Date of Patent: Jul. 15, 2014

(54) UNIVERSAL MOUNT CONTACT BLOCK WITH REVERSIBLE PROTECTED WIRING TERMINALS

(71) Applicant: Hubbell Incorporated., Shelton, CT (US)

(72) Inventors: Sorin I. Mortun, Irvington, NY (US); Rui Chris Zhong, Dongguan (CN)

(73) Assignee: Hubbell Incorporated, Shelton, CT (US)

( * ) Notice: Subject to any disclaimer, the term of this patent is extended or adjusted under 35 U.S.C. 154(b) by 26 days.

(21) Appl. No.: 13/724,075

(22) Filed: Dec. 21, 2012

(51) Int. Cl.
*H01R 13/502* (2006.01)

(52) U.S. Cl.
USPC ..... 439/701; 439/810

(58) Field of Classification Search
USPC ..... 439/701–709, 801, 810
See application file for complete search history.

(56) References Cited

U.S. PATENT DOCUMENTS

| | | | |
|---|---|---|---|
| 5,047,604 | A | 9/1991 | Grass et al. |
| 5,600,291 | A | 2/1997 | Duchemin et al. |
| 5,677,655 | A | 10/1997 | Hinata et al. |
| 6,083,035 | A | 7/2000 | Mackey et al. |
| 6,140,896 | A | 10/2000 | Heckenkamp |
| 6,280,264 | B1 | 8/2001 | Whipple et al. |
| 6,418,027 | B1 | 7/2002 | Suzuki et al. |
| 7,134,921 | B2 | 11/2006 | Siracki et al. |
| 2002/0158729 | A1 | 10/2002 | Allada et al. |
| 2003/0076203 | A1 | 4/2003 | Brooks |
| 2007/0059992 | A1 | 3/2007 | Kim |
| 2011/0261549 | A1 | 10/2011 | Chao et al. |
| 2011/0273844 | A1 | 11/2011 | Rivera Hernandez et al. |

*Primary Examiner* — Khiem Nguyen
(74) *Attorney, Agent, or Firm* — Alan I. Cantor; Mark S. Bicks; Alfred N. Goodman

(57) ABSTRACT

A reconfigurable contact block usable for at least DIN rail and panel mount applications. The contact block's wiring compartments have reversible wiring terminals and reversible, interchangeable protective covers. Lateral wiring ports in each cover guide inserted wires to the covered terminal, and an axially facing cover opening provides tool access to the terminal.

20 Claims, 7 Drawing Sheets

FIG. 1
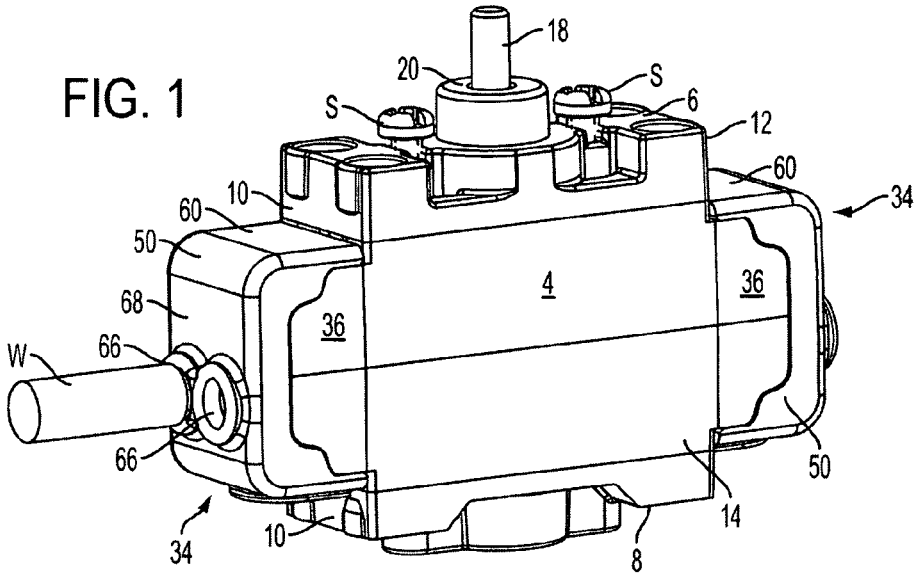
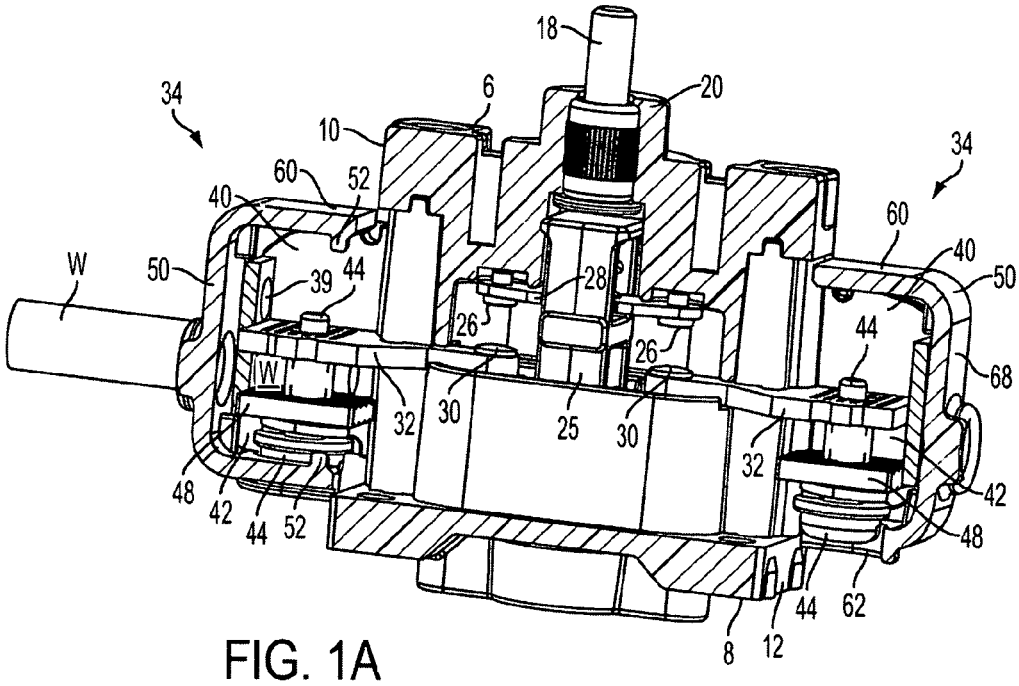
FIG. 1A

UNIVERSAL MOUNT CONTACT BLOCK WITH REVERSIBLE PROTECTED WIRING TERMINALS

FIELD OF THE INVENTION

The invention relates to electric power switches and, in particular, to the contact block portion of a switch, which houses electrical contacts and conductors and has terminals for connecting external wiring to the conductors.

BACKGROUND OF THE INVENTION

Contact blocks have a protruding operating member such as a shaft (reciprocating or rotary) and are specifically built for panel mounting or for DIN rail mounting, but not for both. A contact block built for panel mounting typically is secured against the back of a panel, the operator shaft protruding to the front of the panel through a hole. The close proximity of the panel necessitates rear-facing terminal screws for making the wiring connections. A contact block built for DIN rail mounting typically has a rear-facing slot that embraces a DIN rail. Front-facing terminal screws are provided because the DIN rail and/or its supporting structure would block access to rear-facing terminal screws.

SUMMARY OF THE INVENTION

The invention concerns a reconfigurable contact block that can be mounted at its front (operator) end behind a panel or at its rear end to a DIN rail or other support. The contact block's wiring compartments have reversible wiring terminals and reversible, interchangeable protective covers.

A contact block according to the invention comprises a casing having an axially facing front end, an axially facing rear end, a plurality of sides and internal switching contacts. At least one wiring compartment located at one side of the casing has an open front end and an open rear end. A switch conductor extends laterally into the wiring compartment and substantially divides it into front and rear wiring chambers. An axially extending wiring terminal is in one of the wiring chambers and is connected to the switch conductor, and a removable cover is attached to the casing over the wiring compartment. The cover comprises at least one lateral wiring port axially offset from the switch conductor and an axially facing access opening near the wiring port. The cover and the casing have biaxially symmetrical mating portions that enable reversible attachment of the cover to the casing in either of two orientations so that the wiring chamber in which the wiring terminal is located is accessible by a wire through the wiring port and the wiring terminal is accessible by a tool through the access opening.

The contact block preferably has two wiring compartments located at opposite sides of the casing and two covers, one for each wiring compartment. The covers are substantially identical and the cover-mating portions of the casing are substantially identical so that either cover can be attached to the casing over either wiring compartment in either orientation.

Each wiring compartment preferably comprises a lateral end wall having at least one pair of axially spaced guide ports. Each guide port communicates with a respective wiring chamber and the wiring port of the cover is aligned with one of those guide ports when the cover is attached to the casing.

BRIEF DESCRIPTION OF THE DRAWING

A preferred embodiment of the disclosed invention is described in detail below purely as an example, with reference to the accompanying drawing, in which:

FIG. 1 is a perspective view of a contact block according to an exemplary embodiment of the invention configured for mounting to a panel;

FIG. 1A is a perspective view in section of the contact block of FIG. 1;

DETAILED DESCRIPTION OF THE INVENTION

Figure 2:
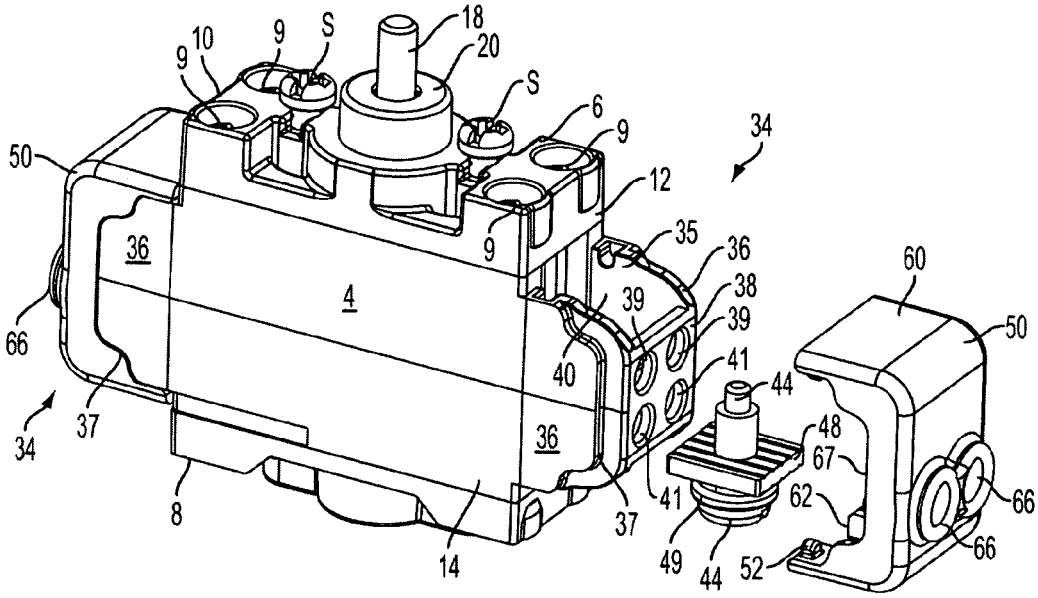
FIG. 2 is a partially exploded view of the contact block of FIG. 1.

As used in this application, terms such as "front," "rear," "side," "top," "bottom," "above," "below," "upward" and "downward" are intended to facilitate the description of the contact block of the invention, and are not intended to limit the structure of the invention to any particular position or orientation.

Referring to FIGS. 1-3, 8 and 9, a contact block according to the invention comprises a molded casing having a central core 4 with a front end 6 facing axially away from the core and a rear end 8 facing axially away from the core in the opposite direction. Screws 9 hold the core components together. The core also has a first side 10; a second side 12 opposite the first side; a third side 14 extending between the first and second sides; and a fourth side 16 opposite the third side. An axially movable input shaft (plunger) 18 extends from a boss 20 at front end 6. Two holes 22 in front end 6 receive mounting screws S for securing the contact block to and against a panel (not shown), which typically has a hole through which boss 20 and shaft 18 would extend. Rear end 8 also has two screw holes 24 for alternate mounting of a DIN rail clip 21 (see FIGS. 10-13), which has a slot 23 adapted to embrace a DIN rail. Alternatively, rear end 8 may be formed with an integral DIN rail slot.

Figure 9:
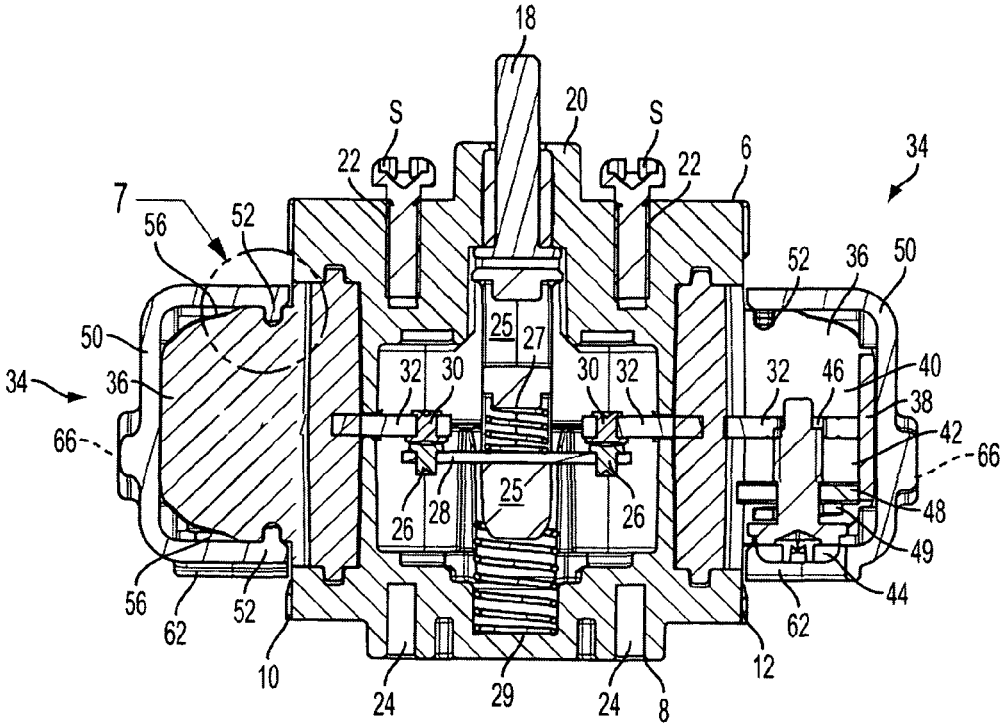
FIG. 9 is a sectional view of the contact block of FIG. 1 taken along line 9-9 in FIG. 8.
Figure 10:
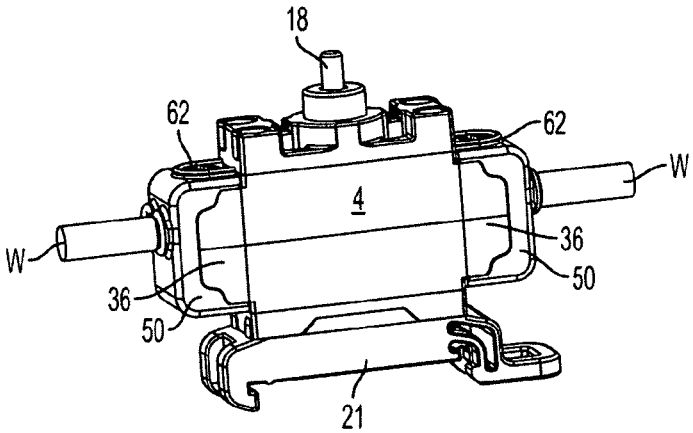
FIG. 10 is a perspective view of a contact block according to an exemplary embodiment of the invention configured for mounting to a DIN rail.
Figure 11:
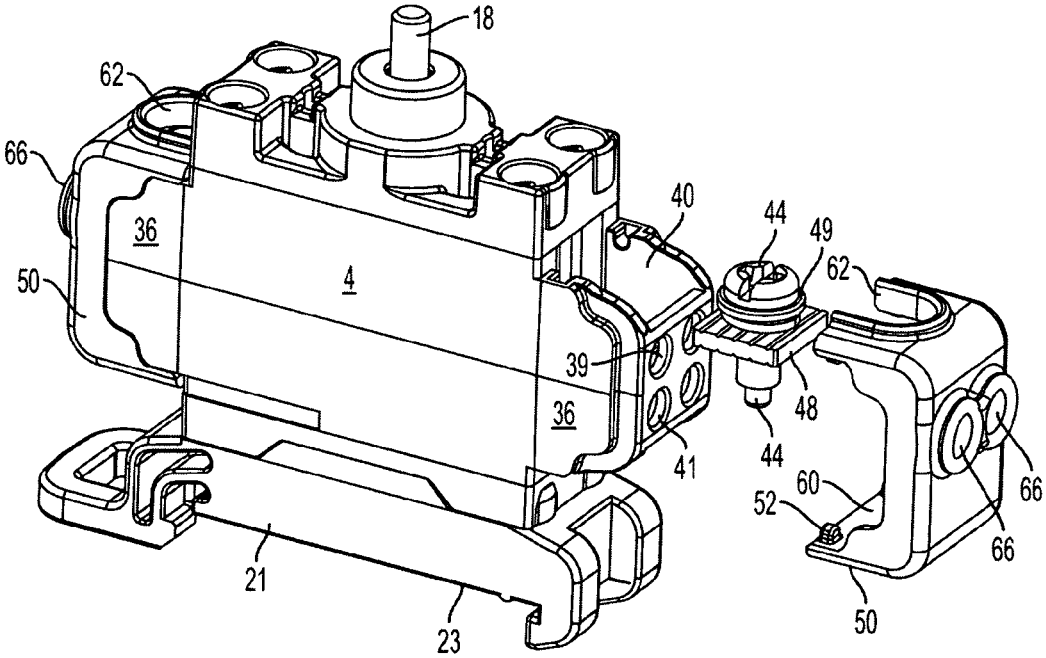
FIG. 11 is a partially exploded view of the contact block of FIG. 10.
Figure 12:
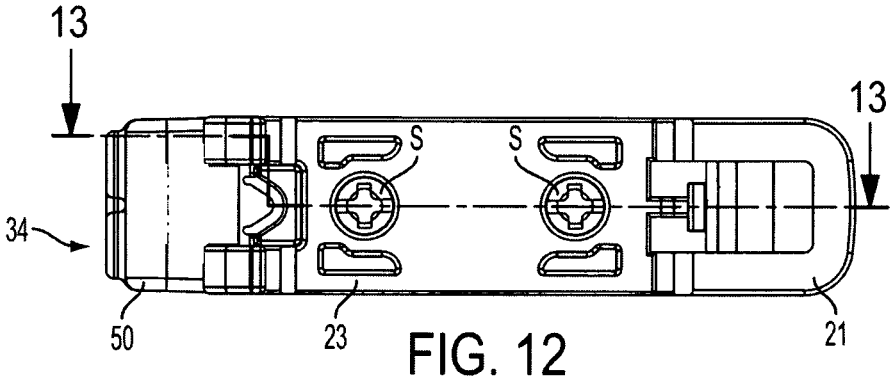
FIG. 12 is a bottom plan view of the contact block of FIG. 10.

As seen in FIG. 9, an axially movable brush 28 within the core carries two brush contacts 26 at its opposite ends. The actuator for this brush contact assembly is conventional and comprises an axially movable contact basket 25 having an aperture through which brush 28 extends; a balance contact spring 27 between contact basket 25 and the front face of brush 28; and an actuation spring 29 between contact basket 25 and the rear end 8 of the core. Brush contacts 26 engage respective stationary contacts 30 carried at the inner ends of respective conductors 32. A pushbutton operator (not shown) on the outer end of shaft 18 provides user input for actuation. FIG. 9 shows an example of a normally closed (NC) actuator arrangement: inward movement of shaft 18 engages contact basket 25 and causes the contacts 26, 30 to separate, breaking the circuit. FIG. 1A shows an example of a normally open (NO) actuator arrangement: inward movement of shaft 18 engages contact basket 25 and causes contacts 26, 30 to close, making the circuit. It should be understood that the invention is not limited to any particular type of internal actuator or contact arrangement, or to the type of external operator that provides user input to the actuator.

Figure 3:
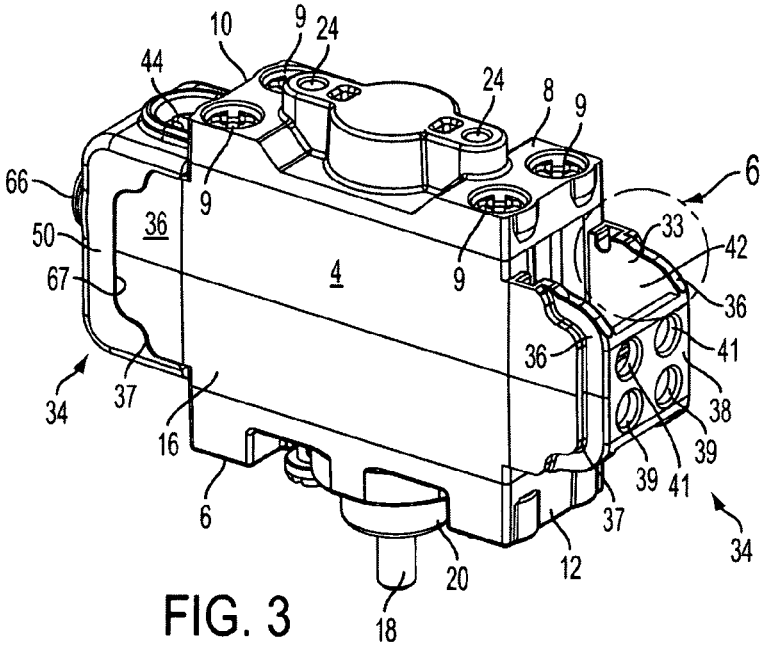
FIG. 3 is an inverted perspective view of the contact block of FIG. 1 with one of its identical wiring compartment covers removed.
Figure 4:
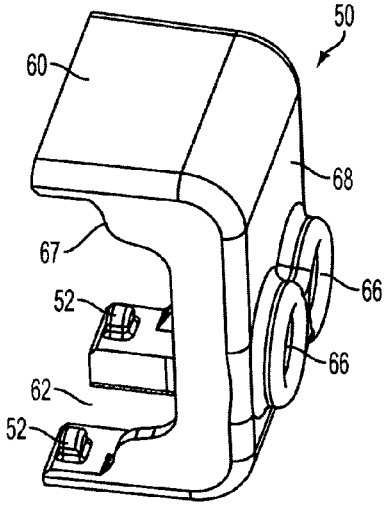
FIG. 4 is an outer perspective view of a wiring compartment cover of the contact block of FIG. 1.
Figure 5:
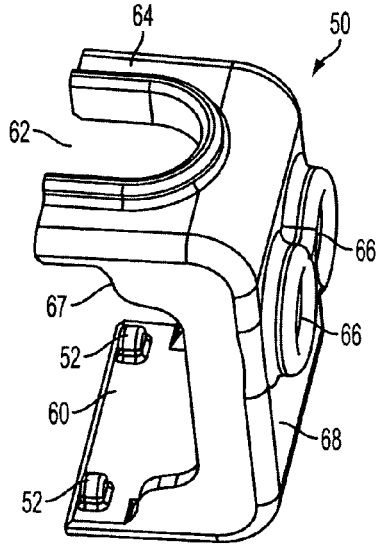
FIG. 5 is an inverted outer perspective view of the cover of FIG. 4.
Figure 4A:
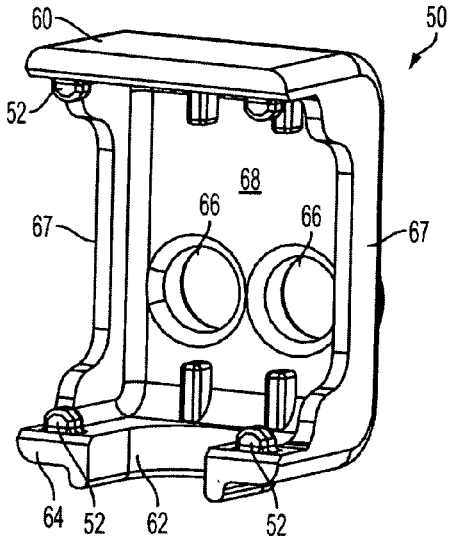
FIG. 4A is an inner perspective view of the cover of FIG. 4.
Figure 5A:
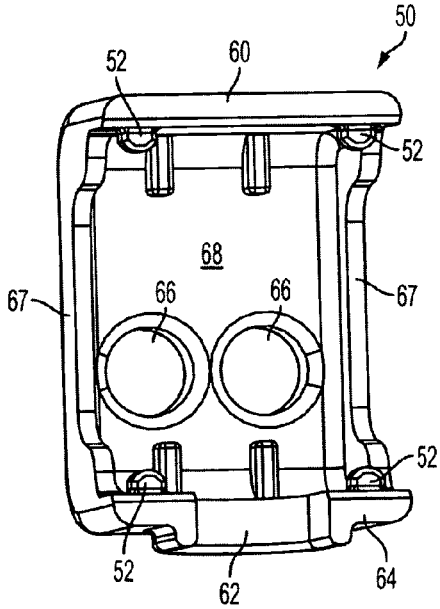
FIG. 5A is another inner perspective view of the cover of FIG. 4.
Figure 6:
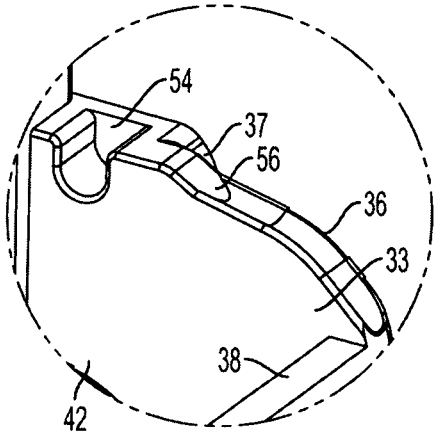
FIG. 6 is a detail perspective view of a portion of FIG. 3.
Figure 7:
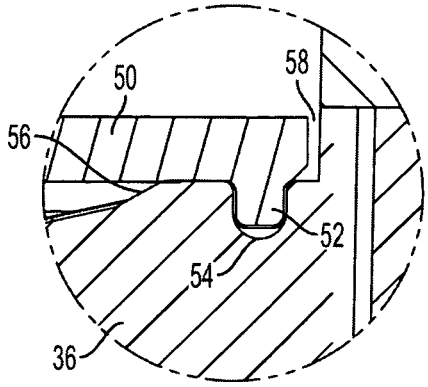
FIG. 7 is a detail sectional view of a portion of FIG. 9.
Figure 14:
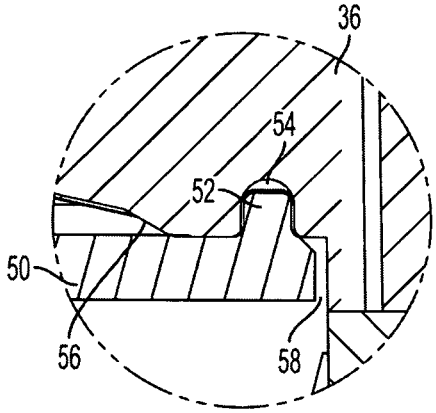
FIG. 14 is a detail sectional view of a portion of FIG. 13.
Figure 8:
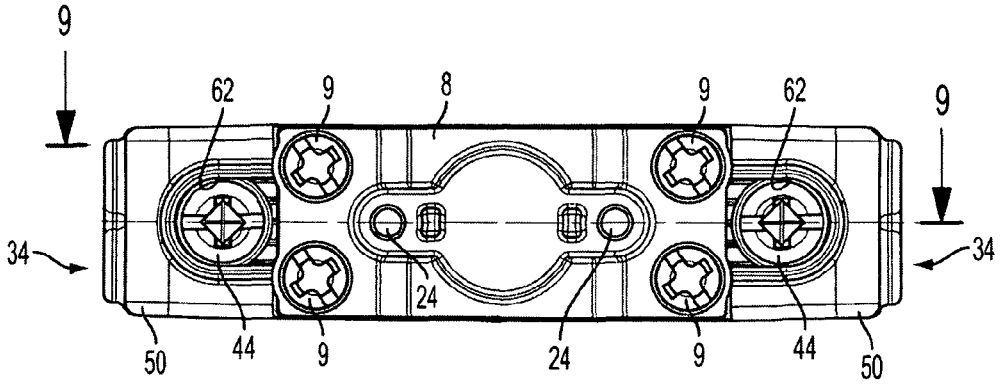
FIG. 8 is a bottom plan view of the contact block of FIG. 1.

Referring to FIGS. 2, 3 and 9, each side 10, 12 of the core has an integrally formed wiring compartment 34 defined by parallel tapered extensions 36 of sides 14, 16 and an interconnecting lateral end wall 38. The edges of extensions 36 and end wall 38 define a front opening 35 and a rear opening 33 for tool access to the wiring compartment. Each end wall 38 has a pair of front wire guide ports 39 and a pair of rear wire guide ports 41. Referring to FIGS. 1A and 9, each conductor 32 extends laterally outward into its respective wiring compartment 34, substantially dividing it into a front wiring chamber 40 adjacent guide ports 39 and a rear wiring chamber 42 adjacent guide ports 41. Thus, each front wire guide port 39 serves to guide the end of a wire into front wiring chamber 40 and each rear wire guide port 41 serves to guide the end of a wire into rear wiring chamber 42.

Figure 13:
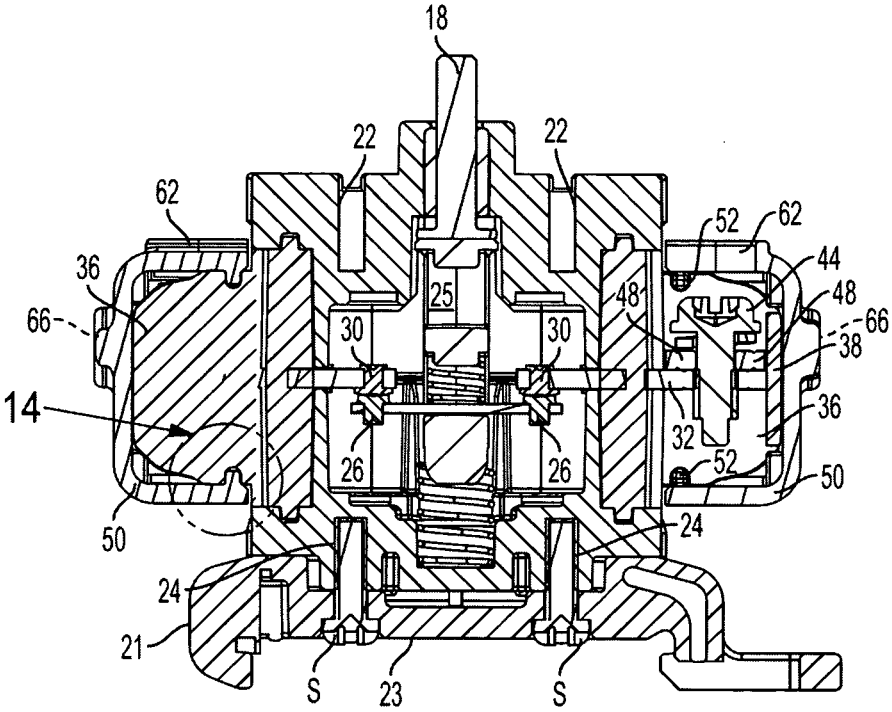
FIG. 13 is a sectional view of the contact block of FIG. 10 taken along line 13-13 in FIG. 12.

A terminal assembly for each wiring compartment 34 is connected to conductor 32 in one of the wiring chambers depending on the application: in rear wiring chamber 42 for panel mounting as shown in FIGS. 1A and 9; in front wiring chamber 40 for DIN rail mounting as shown in FIG. 13. Each terminal assembly is conventional and comprises a terminal screw 44 that engages a threaded hole 46 in conductor 32 and preferably includes a lock washer 49 beneath the head of the screw and a roughened wire clamping washer 48, which can clamp one or two wires inserted through the wire guide port (s) 39 or 41.

Referring to FIGS. 2-7 and 14, each wiring compartment 34 is provided with a protective molded cover 50 that snaps onto casing 4 and is held in place by four corner snap tabs 52 that respectively engage four recesses 54 in casing extensions 36. The sloped edges 56 of extensions 36 act as ramps that spread opposing tabs 52 apart as cover 50 is pressed onto the wiring compartment until the tabs reach and engage recesses 54. Cover 50 can be pried off if necessary by inserting and twisting a flat screwdriver blade or similar tool in the gap 58 between the casing and the cover. Cover 50 also has a solid end wall 60, a U-shaped terminal access opening 62 in the opposite end wall 64 and a side-by-side pair of wiring ports 66 in its lateral end wall 68 that are axially offset toward opening 62.

Cover 50 has a universal configuration that enables it to be installed over either wiring compartment 34 in either of two orientations as required by the mounting application, i.e., as a function of which wiring chamber 40, 42 houses the terminal assembly. For panel mounting, cover 50 would be installed with its opening 62 facing rearward to enable access to terminal screw 44 in rear wiring chamber 42 (see FIGS. 1, 1A, 2, 3, 8 and 9). For DIN rail mounting, cover 50 would be installed with its opening 62 facing forward to enable access to terminal screw 44 in front wiring chamber 40 (see FIGS. 10-13). In either orientation, cover wiring ports 66 are aligned with one pair of wiring chamber guide ports 39 or 40 so that one or two wires W can be inserted through the aligned ports and into the appropriate wiring chamber, where they can be clamped by tightening the terminal screw 44 (see FIG. 1A).

The positional versatility of cover 50 is due to the biaxial symmetry of the mating portions of the cover and the casing, as is evident in FIGS. 2-9, 13 and 14. The mating portions of the casing, which are identical on each side 10, 12, comprise (1) the laterally protruding contoured edge 37 of each side extension 36, which has a double reverse curved and straight profile, and (2) the four tab-receiving recesses 54. These casing features collectively are symmetrical about a longitudinal axial plane, i.e., one containing the axis of shaft 18 and bisecting both wiring compartments 34. They are also symmetrical about a plane perpendicular to that axial plane and bisecting both wiring compartments between guide ports 39 and 41. The mating portions of the cover comprise (1) its two contoured edges 67, which are substantially congruent with the contoured edges 37 of the casing, and (2) its four snap tabs 52, which are axially and laterally spaced to fit into recesses 54. These mating cover features collectively are symmetrical about the same two perpendicular planes.

While a preferred embodiment has been chosen to illustrate the contact block of the invention, it will be understood by those skilled in the art that various changes and modifications may be made without departing from the scope of the invention as defined by the appended claims.

What is claimed is:

1. A contact block comprising:

a casing having an axially facing front end, an axially facing rear end, first and second opposite sides and internal switching contacts;

a first wiring compartment located at the first side of the casing and having an open front end and an open rear end;

a first switch conductor extending laterally into and substantially dividing said first wiring compartment into front and rear wiring chambers;

an axially extending first wiring terminal in one of said wiring chambers connected to said first switch conductor; and a first cover removably attached to said casing over said first wiring compartment, said first cover including at least one lateral wiring port axially offset from said first switch conductor and an axially facing access opening near said wiring port, said first cover and said casing having substantially biaxially symmetrical mating portions that enable reversible attachment of said first cover to said casing in either of two orientations so that the wiring chamber in which said first wiring terminal is located is accessible by a wire through said wiring port and said first wiring terminal is accessible by a tool through said access opening.

2. The contact block of claim 1, wherein said first cover comprises snap tabs that engage said casing.

3. The contact block of claim 2, wherein said casing comprises notches configured to retain said snap tabs.

4. The contact block of claim 3, wherein said first cover is generally C-shaped and has two free ends, and said snap tabs are located at said free ends.

5. The contact block of claim 1, wherein said first wiring compartment comprises a lateral end wall having at least one pair of axially spaced guide ports, each guide port communicating with a respective wiring chamber, and said wiring port is aligned with one of said guide ports when said first cover is attached to said casing.

6. The contact block of claim 5, wherein said first cover comprises two wiring ports disposed side-by-side and axially offset from said first conductor, and the lateral end wall of said wiring compartment comprises two pairs of guide ports.

7. The contact block of claim 1, wherein said first wiring terminal comprises a terminal screw.

8. The contact block of claim 1, wherein said front end comprises at least one screw hole for mounting the contact block.

9. The contact block of claim 8, wherein said rear end comprises at least one screw hole for mounting the contact block.

10. The contact block of claim 1, further comprising:

a second wiring compartment located said second side of said casing and having an open front end and an open rear end;

a second switch conductor extending laterally into and substantially dividing said second wiring compartment into front and rear wiring chambers;

a second axially extending wiring terminal disposed in a wiring chamber of said second wiring compartment and connected to said second switch conductor; and a second cover removably attached to said casing over said second wiring compartment and including at least one lateral wiring port axially offset from said second switch conductor and an axially facing access opening near said wiring port, said second cover and said casing having substantially biaxially symmetrical mating portions that enable reversible attachment of said second cover to said casing in either of two orientations so that the wiring chamber in which said second wiring terminal is located is accessible by a wire through said wiring port and said second wiring terminal is accessible by a tool through said access opening, and the cover-mating portions of said casing at said first and second sides are substantially identical and the casing-mating portions of said covers are substantially identical, whereby either cover can be attached to said casing over either wiring compartment in either of two orientations.

11. A contact block for DIN rail and panel mounting, comprising:

a casing having an axially facing front end, an axially facing rear end, a first side and a second side;

first and second stationary contacts within said casing;

a movable contact assembly that can be actuated from said front end for making and/or breaking an electrical connection between said first and second stationary contacts;

first and second wiring compartments located respectively at said first and second sides, each wiring compartment having an open front end and an open rear end;

first and second terminals located respectively in said first and second wiring compartments, each terminal comprising a laterally extending switch conductor electrically connected to its respective stationary contact and substantially dividing its respective wiring compartment into front and rear wiring chambers, and an axially extending terminal screw in one of said wiring chambers connected to said switch conductor;

first and second covers removably attached to said casing respectively over said first and second wiring compartments;

at least one attachment point at said front end for mounting the contact block to a panel; and at least one attachment point at said rear end for mounting the contact block to a DIN rail or a DIN rail adapter, wherein each of said covers comprises at least one lateral wiring port axially offset from its respective switch conductor and an axially facing access opening near said wiring port, and said covers and said casing have substantially biaxially symmetrical mating portions that enable reversible attachment of said covers to said casing in either of two orientations so that the wiring chamber in which said terminal screw is located is accessible by a wire through said wiring port and said terminal screw is accessible by a tool through said opening.

12. The contact block of claim 11, wherein each cover comprises snap tabs that engage said casing.

13. The contact block of claim 12, wherein said casing comprises notches configured to retain said snap tabs.

14. The contact block of claim 13, wherein each cover is generally C-shaped and has two free ends, and said snap tabs are located at said free ends.

15. The contact block of claim 11, wherein each wiring compartment comprises a lateral end wall having at least one pair of axially spaced guide ports, each guide port communicating with a respective wiring chamber, and said wiring port is aligned with one of said guide ports when the respective cover is attached to said casing.

16. The contact block of claim 15, wherein each cover comprises a pair of wiring ports disposed side-by-side and axially offset from the respective conductor, and the lateral end wall of each wiring compartment comprises two pairs of guide ports.

17. The contact block of claim 11, wherein said first side and second side are at opposite sides of said casing and have substantially identical cover-mating portions.

18. The contact block of claim 17, wherein said covers have substantially identical casing-mating portions whereby either cover can be attached to said casing over either wiring compartment in either of two orientations.

19. The contact block of claim 11, wherein said at least one attachment point at said front end comprises at least one screw hole.

20. The contact block of claim 19, wherein said at least one attachment point at said rear end comprises at least one screw hole for attaching a DIN rail adapter.

* * * * *